US008343447B2

(12) United States Patent
Shibayama et al.

(10) Patent No.: US 8,343,447 B2
(45) Date of Patent: Jan. 1, 2013

(54) HYDROMETALLURGICAL PROCESS FOR A NICKEL OXIDE ORE

(75) Inventors: Keisuke Shibayama, Tokyo (JP); Yoshitomo Ozaki, Tokyo (JP); Osamu Nakai, Tokyo (JP)

(73) Assignee: Sumitomo Metal Mining Co., Ltd., Tokyo (JP)

( * ) Notice: Subject to any disclaimer, the term of this patent is extended or adjusted under 35 U.S.C. 154(b) by 769 days.

(21) Appl. No.: 12/458,677

(22) Filed: Jul. 20, 2009

(65) Prior Publication Data

US 2010/0018350 A1 Jan. 28, 2010

(30) Foreign Application Priority Data

Jul. 25, 2008 (JP) ..... 2008-191698

(51) Int. Cl.

| | |
|---|---|
| ***B01D 19/00*** | (2006.01) |
| ***B01D 43/00*** | (2006.01) |
| ***B01D 53/52*** | (2006.01) |
| ***C01G 9/08*** | (2006.01) |
| ***C01G 51/00*** | (2006.01) |
| ***C01G 53/11*** | (2006.01) |

(52) U.S. Cl. ..... 423/140; 423/101; 423/109; 423/150.1; 423/234; 423/658.5; 210/702

(58) Field of Classification Search ..... 423/99, 423/101, 102, 109, 138, 140, 142, 150.1, 423/220, 234, 658.1; 75/710, 711, 743; 95/156, 95/158, 172, 175, 176, 177, 181; 210/702, 210/712, 714, 723, 738, 749, 752

See application file for complete search history.

(56) References Cited

FOREIGN PATENT DOCUMENTS

| | | | |
|---|---|---|---|
| JP | 2002-121624 A | | 4/2002 |
| JP | 2002121624 A | * | 4/2002 |
| JP | 2003-313617 A | | 11/2003 |
| JP | 2005-350766 A | | 12/2005 |

OTHER PUBLICATIONS

Applicant admitted prior art from pp. 2-4 of applicant's specification as filed Jul. 20, 2009.*
Machine translation of JP 2002-121624.*

* cited by examiner

*Primary Examiner* — Roy King
*Assistant Examiner* — Jared Wood
(74) *Attorney, Agent, or Firm* — Edwards Wildman Palmer LLP; James E. Armstrong, IV; Weiying Yang

(57) ABSTRACT

A hydrometallurgical process for a nickel oxide ore comprising obtaining an aqueous solution of crude nickel sulfate by high pressure acid leaching of a nickel oxide ore; obtaining a zinc free final solution by sulfurization of the solution; obtaining a waste solution; and scrubbing hydrogen sulfide gas from an exhaust gas. The process is characterized by at least one of the following operations: Adjusting the total volume ($m^3$) of a sulfurization reactor to a ratio of 0.2-0.9 ($m^3$/kg/h) relative to the input mass (kg/h) of the nickel to be introduced to the reactor; and/or subjecting the waste solution and the exhaust gas to countercurrent contact, then introducing the exhaust gas back to the scrubber and charging the waste solution from the scrubber into the sulfurization reactor.

8 Claims, 3 Drawing Sheets

HYDROMETALLURGICAL PROCESS FOR A NICKEL OXIDE ORE

BACKGROUND OF THE INVENTION

1. Field of the Invention

The present invention relates to a hydrometallurgical process for a nickel oxide ore, and in more detail, the present invention relates to a hydrometallurgical process for a nickel oxide ore, which is capable of reducing use amount of hydrogen sulfide gas in a sulfurization step and use amount of an alkali to be used in exhaust gas treatment, and decreasing operation cost, by enhancement of utilization efficiency of hydrogen sulfide gas, while maintaining nickel recovery rate to a high yield of equal to or higher than 95%, and preferably equal to or higher than 98%, in a hydrometallurgical process for a nickel oxide ore including:

a step (1) for obtaining an aqueous solution of crude nickel sulfate by High Pressure Acid Leach of a nickel oxide ore, a step (2) for obtaining zinc sulfide and a zinc free final solution formed by introduction of the above aqueous solution of crude nickel sulfate into the inside of a sulfurization reactor (A), then the addition of hydrogen sulfide gas, a step (3) for obtaining a mixed sulfide of nickel/cobalt and a waste solution by introduction of the above zinc free final solution into the inside of a sulfurization reactor (B), then the addition of hydrogen sulfide gas, and a step (4) for scrubbing treatment of hydrogen sulfide gas in exhaust gas generating in the above steps (2) and (3).

2. Description of the Prior Art

A High Pressure Acid Leach using sulfuric acid has been noticed in recent years, as the hydrometallurgical process for a nickel oxide ore. This method is composed of wet process steps throughout, without dry process treatment steps such as drying and roasting steps and the like, thus providing advantages not only in view of energy and cost saving but also in being capable of obtaining a mixed sulfide of nickel/cobalt having an enhanced nickel content of up to about 50% by weight.

As the High Pressure Acid Leach for obtaining the above mixed sulfide of nickel/cobalt, for example, there has been used a method including: a step (1) for obtaining an aqueous solution of crude nickel sulfate containing zinc as an impurity element, in addition to nickel and cobalt, by High Pressure Acid Leach of a nickel oxide ore, a step (2) for obtaining zinc sulfide and a zinc free final solution formed, by introduction of the above aqueous solution of crude nickel sulfate into the inside of a sulfurization reactor (A), then the addition of hydrogen sulfide gas, sulfurization of zinc contained in the aqueous solution of crude nickel sulfate, and then solid-liquid separation, a step (3) for obtaining a mixed sulfide of nickel/cobalt and a waste solution, by introduction of the above zinc free final solution into the inside of a sulfurization reactor (B), then the addition of hydrogen sulfide gas, sulfurization of nickel and cobalt contained in the zinc free final solution, and subsequently introduction of slurry formed into an evaporation apparatus for evaporation of hydrogen sulfide gas, and then solid-liquid separation, and a step (4) for scrubbing treatment of hydrogen sulfide gas in exhaust gas generating in the above steps (2) and (3).

FIG. 1 shows an example of a process chart of a hydrometallurgical process for a nickel oxide ore according to a High Pressure Acid Leach.

In FIG. 1, a nickel oxide ore 5 is firstly subjected to High Pressure Acid Leach using sulfuric acid to form leached slurry, in the step (1). Next, the leached slurry is subjected to solid-liquid separation, and after multi-stage washings, separated to a leachate containing nickel and cobalt, and a leaching residue 7. The above leachate is subjected to neutralization to form the neutralized precipitate slurry containing a trivalent iron hydroxide, and an aqueous solution 6 of crude nickel sulfate. After that, the aqueous solution 6 of crude nickel sulfate is subjected to the sulfurization step composed of the step (2) and the step (3), and separated to a zinc sulfide 9 and a zinc free final solution 8, and a mixed sulfide 10 of nickel/cobalt and a waste solution 11, respectively. A sulfurization reactor to be used in this sulfurization step, is usually composed of a closed-type reactor equipped with a supply port of a reaction starting solution, an outlet of slurry after the reaction, a charge hole of hydrogen sulfide gas, and an exhaust gas hole.

It should be noted that exhaust gas 12 containing hydrogen sulfide gas generating from the step (2) and the step (3) is introduced into a scrubber of a step (4), and it is subjected to contact with the alkaline aqueous solution for absorption of hydrogen sulfide gas. The resulting waste solution from the scrubber obtained here is treated separately. Still more, a waste solution 11 is circulated to be used as a washing solution in solid-liquid separation in the step (1).

Here, the above step (1) is composed of a leaching step for obtaining leached slurry, by the addition of sulfuric acid into slurry of a nickel oxide ore and leaching at a high temperature of equal to or high than 200° C. under high pressure using an autoclave, a solid-liquid separation step for separation to the leaching residue in leached slurry and a leachate containing nickel and cobalt, and a neutralization step for forming the neutralized precipitate slurry containing impurity elements such as iron, and a starting solution for a sulfurization reaction, by adjustment of pH of the leachate containing impurity elements, in addition to nickel and cobalt.

In addition, in the above steps (2) and (3), a sulfurization reaction is carried out by the addition of hydrogen sulfide gas into the aqueous solution of crude nickel sulfate containing zinc as an impurity element, in addition to nickel and cobalt, to form a metal sulfide. Therefore, enhancement of efficiency of the sulfurization reaction is important.

As for the enhancement of efficiency of this sulfurization reaction, the following sulfurization methods have been disclosed. For example, a method for controlling the sulfurization reaction of metals by using hydrogen sulfide gas as a sulfurizing agent and adjusting concentration of hydrogen sulfide in a vapor phase, and correctly controlling ORP or pH in a solution (for example, refer to Patent Literature 1), a method for the addition of a sulfide seed crystal to promote the sulfurization reaction, as well as to suppress the adhesion of a generating sulfide onto the inner surface of the reactor (for example, refer to Patent Literature 2), and a method for separation of zinc preferentially, by adjustment of pH and ORP of the aqueous solution of nickel sulfate containing cobalt and zinc (for example, refer to Patent Literature 3) and the like. These conventional technologies are effective technologies to solve each of the problems, even in the above High Pressure Acid Leach.

Incidentally, as the operation method of the above step (3), for example, operation is carried out under control of operation conditions such as nickel concentration, introduction flow amount, temperature, pH of a reaction starting solution to be introduced into the sulfurization reactor, at predetermined values, by blowing the hydrogen sulfide gas having a hydrogen sulfide gas concentration of equal to or higher than 95% by volume into the vapor phase inside the sulfurization reactor and controlling the inner pressure thereof at predetermined value, and also, if necessary, by the addition of the sulfide seed crystal. This way enabled to secure a nickel recovery rate of equal to or higher than 95%. However, in order to enhance the nickel recovery rate stably at a still higher level, it is considered to carry out the reaction in a state of more increased temperature and pressure inside the sulfurization reactor. This case raises problems of use amount of hydrogen sulfide gas, along with treatment cost of exhaust gas from a reaction system, or cost of a reaction apparatus, therefore enhancement of utilization efficiency of hydrogen sulfide gas to be added to the sulfurization step is required, to solve these problems. However, there is no description, in the above conventional technology, on enhancement of utilization efficiency of hydrogen sulfide gas.

Still more, in a production facility of hydrogen sulfide gas to be used industrially in a plant of a hydrometallurgical process for such as a practical operation plant of the above High Pressure Acid Leach, it is advantageous, in view of production efficiency thereof, to produce and use gas having a hydrogen sulfide gas concentration of below 100% by volume. Therefore, in hydrogen sulfide gas to be added inside the sulfurization reactor, hydrogen of a raw material in the production step of hydrogen sulfide gas, or an inert component such as nitrogen commingling in the production step of hydrogen sulfide gas, is contained in an amount of about 2 to 3% by volume. That is, hydrogen or nitrogen is included as an inert component not involved in the sulfurization reaction.

Therefore, in continued implementation of the operation in the sulfurization step such as the above steps (2), (3), the above inert component is accumulated inside the sulfurization reactor, causing decrease in sulfurization reaction efficiency. Therefore, such an operation is carried out that gas inside the sulfurization reactor is periodically discharged outside the system. In this case, because not only the inert component but also residual hydrogen sulfide gas are discharged at the same time, as exhaust gas, loss of hydrogen sulfide gas generates. In addition, exhaust gas from the inside of this sulfurization reactor essentially requires scrubbing treatment such as absorption of hydrogen sulfide gas, for example, by subjecting to contact with an alkaline aqueous solution, therefore increase in use amount of hydrogen sulfide gas increases use amount of the alkali. As countermeasures thereof, it is considered to decrease vapor phase pressure or concentration of hydrogen sulfide inside the sulfurization reactor, however, this countermeasures, as described above, raises a problem of making it difficult to secure a nickel recovery rate of equal to or higher than 95%, which is a minimal level necessary as efficiency of total operation, and preferably equal to or higher than 98%.

Under these circumstances, in a practical operation plant of the conventional High Pressure Acid Leach, a nickel recovery rate of equal to or higher than 95% in a mixed sulfide of nickel/cobalt, has been secured by the excess addition of use amount of hydrogen sulfide gas, in a degree of about 1.3 to 1.4 time hydrogen sulfide amount required theoretically in view of the sulfurization reaction. Therefore, such a method has been required that is capable of reducing the use amount of hydrogen sulfide gas in the sulfurization step, and the use amount of the alkali to be used in exhaust gas treatment, and decreasing operation cost, while maintaining the nickel recovery rate of equal to or higher than 95%.

[Patent Literature 1] JP-A-2003-313617 (page 1 and page 2)
[Patent Literature 2] JP-A-2005-350766 (page 1 and page 2)
[Patent Literature 3] JP-A-2002-121624 (page 1 and page 2)

SUMMARY OF THE INVENTION

In view of the above conventional technological problems, it is an object of the present invention to provide a hydrometallurgical process for a nickel oxide ore, which is capable of reducing use amount of hydrogen sulfide gas in a sulfurization step and use amount of an alkali to be used in exhaust gas treatment, and decreasing operation cost, by enhancement of utilization efficiency of hydrogen sulfide gas, while maintaining nickel recovery rate to a high yield of equal to or higher than 95%, and preferably equal to or higher than 98%, in a hydrometallurgical process for a nickel oxide ore including: a step (1) for obtaining an aqueous solution of crude nickel sulfate by High Pressure Acid Leach of a nickel oxide ore, a step (2) for obtaining zinc sulfide and a zinc free final solution formed by introduction of the above aqueous solution of crude nickel sulfate into the inside of a sulfurization reactor (A), then the addition of hydrogen sulfide gas, a step (3) for obtaining a mixed sulfide of nickel/cobalt and a waste solution by introduction of the above zinc free final solution into the inside of a sulfurization reactor (B), then the addition of hydrogen sulfide gas, and a step (4) for scrubbing treatment of hydrogen sulfide gas in exhaust gas generating in the above steps (2) and (3).

The present inventors have intensively studied on enhancement of utilization efficiency of hydrogen sulfide gas in a hydrometallurgical process for a nickel oxide ore for recovering each of zinc, nickel and cobalt as a sulfide by High Pressure Acid Leach of a nickel oxide ore, and by the addition of hydrogen sulfide gas to an aqueous solution of crude nickel sulfate containing zinc as an impurity element, in addition to nickel and cobalt, to attain the above object, and found that use amount of hydrogen sulfide gas in a sulfurization step, and use amount of an alkali to be used in exhaust gas treatment can be reduced, and operation cost can be decreased, by enhancement of utilization efficiency of hydrogen sulfide gas, while maintaining nickel recovery rate to a high yield of equal to or higher than 95%, and preferably equal to or higher than 98%, by adoption of at least one kind of the following operations (a) to (d), and have thus completed the present invention:

(a) to adjust a total volume ($m^3$) of the sulfurization reactor (B) to be used, so that a ratio of 0.2 to 0.9 ($m^3$/kg/h) is attained relative to input mass per unit hour (kg/h) of nickel contained in the zinc free final solution to be introduced, in the above step (3);

(b) to evaporate under negative pressure, in evaporation of hydrogen sulfide gas dissolved in a solution of the slurry in the above step (3), and to add the recovered hydrogen sulfide gas into the inside of the sulfurization reactor (B) of the above step (3);

(c) to reuse the hydrogen sulfide gas containing inert components from the sulfurization reactor (B), which gas is accumulated in the gas phase part thereof, by pressure control inside the sulfurization reactor (B), in the above step (3), and add it into the inside of the sulfurization reactor (A) of the above step (2), and (d) to subject the waste solution in the above step (3) and exhaust gas scrubbed in the above step (4) to countercurrent contact, and to introduce the resulting exhaust gas to the scrubber again, and to subject it to contact with the alkaline aqueous solution for absorption of hydrogen sulfide gas, and to charge the resulting waste solution from the scrubber into the sulfurization reactor (B) in the above step (3).

That is, according to a first aspect of the present invention, there is provided a hydrometallurgical process for a nickel oxide ore including: a step (1) for obtaining an aqueous solution of crude nickel sulfate containing zinc as an impurity element, in addition to nickel and cobalt, by High Pressure Acid Leach of a nickel oxide ore, a step (2) for obtaining zinc sulfide and a zinc free final solution formed, by introduction of the above aqueous solution of crude nickel sulfate into the inside of a sulfurization reactor (A), then the addition of hydrogen sulfide gas, sulfurization of zinc contained in the aqueous solution of crude nickel sulfate, and then solid-liquid separation, a step (3) for obtaining a mixed sulfide of nickel/cobalt and a waste solution, by introduction of the above zinc free final solution into the inside of a sulfurization reactor (B), then the addition of hydrogen sulfide gas, sulfurization of nickel and cobalt contained in the zinc free final solution, and subsequently introduction of slurry formed into an evaporation apparatus for evaporation of hydrogen sulfide gas, and then solid-liquid separation, and a step (4) for obtaining an exhaust gas scrubbed and a waste solution from a scrubber, by introduction of exhaust gas from the above sulfurization reactor (A), sulfurization reactor (B) or evaporation apparatus into the scrubber, and subjecting it to contact with an alkaline aqueous solution for absorption of hydrogen sulfide gas;

characterized in that at least one kind of the following operations (a) to (d) is adopted:

(a) to adjust total volume ($m^3$) of the sulfurization reactor (B) to be used, so that a ratio of 0.2 to 0.9 ($m^3$/kg/h) is attained, relative to input mass per unit hour (kg/h) of nickel, contained in the zinc free final solution to be introduced, in the above step (3);

(b) to evaporate, under negative pressure, in evaporation of hydrogen sulfide gas dissolved in a solution from slurry generating in the above step (3), and to add hydrogen sulfide gas recovered into the inside of the sulfurization reactor (B) of the above step (3);

(c) to reuse the hydrogen sulfide gas containing inert components from the sulfurization reactor (B), which gas is accumulated in the gas phase part thereof, by pressure control inside the sulfurization reactor (B), in the above step (3), and add it into the inside of the sulfurization reactor (A) of the above step (2), and (d) to subject the waste solution in the above step (3) and exhaust gas scrubbed in the above step (4) to countercurrent contact, and to introduce the resulting exhaust gas to the scrubber again, and to subject it to contact with the alkaline aqueous solution for absorption of hydrogen sulfide gas, and to charge the resulting waste solution from the scrubber, into the sulfurization reactor (B) in the above step (3).

In addition, according to a second aspect of the present invention, there is provided the hydrometallurgical process for a nickel oxide ore in the first aspect of the present invention, characterized in that, in the above operation (a), the ratio is 0.6 to 0.9 ($m^3$/kg/h).

In addition, according to a third aspect of the present invention, there is provided the hydrometallurgical process for a nickel oxide ore in the first aspect of the present invention, characterized in that, in the above operation (a), the sulfurization reactor (B) comprises three or four units of reactors connected in series.

In addition, according to a fourth aspect of the present invention, there is provided the hydrometallurgical process for a nickel oxide ore in the first aspect of the present invention, characterized in that, in the above operation (b), the above negative pressure is equal to or higher than −70 kPaG.

In addition, according to a fifth aspect of the present invention, there is provided the hydrometallurgical process for a nickel oxide ore in the first aspect of the present invention, characterized in that, in the above operation (d), the above alkaline aqueous solution is an aqueous solution of sodium hydroxide, and use amount of sodium hydroxide is adjusted at 180 to 200 kg per 1 ton of input mass of nickel contained in the zinc free final solution to be introduced to the above step (3).

Figure 1:
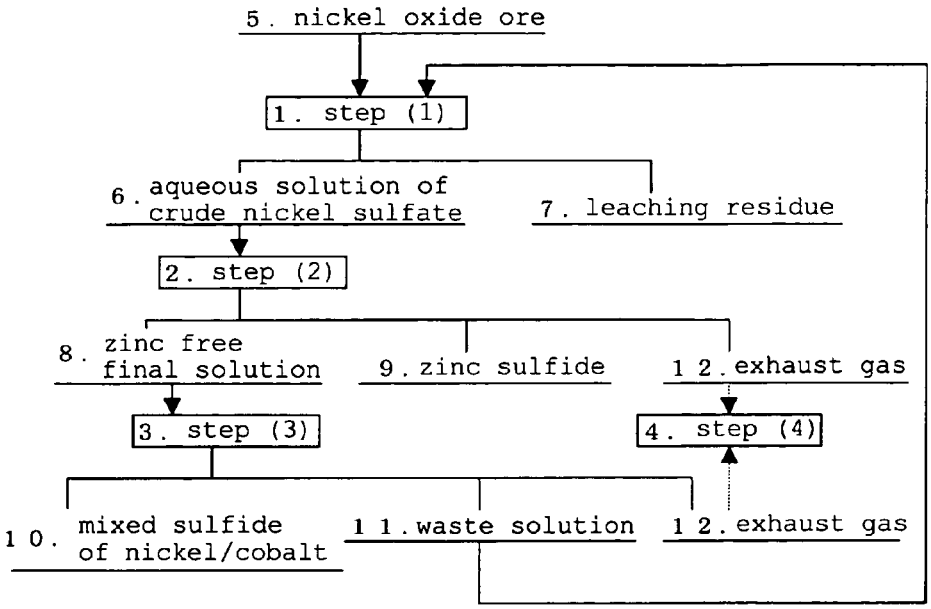
FIG. 1 is a drawing showing an example of a process chart of a hydrometallurgical process for a nickel oxide ore, according to a conventional High Pressure Acid Leach.

NOTATION 1 step (1)
2 step (2)
3 step (3)
4 step (4)
5 nickel oxide ore
6 aqueous solution of crude nickel sulfate
7 leaching residue
8 zinc free final solution
9 zinc sulfide
10 mixed sulfide of nickel/cobalt
11 waste solution
12 exhaust gas

DETAILED DESCRIPTION OF THE INVENTION

The hydrometallurgical process for a nickel oxide ore of the present invention is capable of reducing use amount of hydrogen sulfide gas in a sulfurization step, and use amount of an alkali to be used in exhaust gas treatment, and decreasing operation cost, by enhancement of utilization efficiency of hydrogen sulfide gas, while maintaining nickel recovery rate to a high yield of equal to or higher than 95%, and preferably equal to or higher than 98%, in the hydrometallurgical process for a nickel oxide ore using the above High Pressure Acid Leach, and thus industrial value thereof is extremely large.

Explanation will be given below in detail on the hydrometallurgical process for a nickel oxide ore of the present invention.

The hydrometallurgical process for a nickel oxide ore of the present invention is characterized in that at least one kind of the following operations (a) to (d) is adopted, in a hydrometallurgical process for a nickel oxide ore including: a step (1) for obtaining an aqueous solution of crude nickel sulfate containing zinc as an impurity element, in addition to nickel and cobalt, by High Pressure Acid Leach of a nickel oxide ore, a step (2) for obtaining zinc sulfide and a zinc free final solution formed, by introduction of the above aqueous solution of crude nickel sulfate into the inside of a sulfurization reactor (A), then the addition of hydrogen sulfide gas, sulfurization of zinc contained in the aqueous solution of crude nickel sulfate, and then solid-liquid separation, a step (3) for obtaining a mixed sulfide of nickel/cobalt and a waste solution, by introduction of the above zinc free final solution into the inside of a sulfurization reactor (B), then the addition of hydrogen sulfide gas, sulfurization of nickel and cobalt contained in the zinc free final solution, and subsequently introduction of slurry formed into an evaporation apparatus for evaporation of hydrogen sulfide gas, and then solid-liquid separation, and a step (4) for obtaining an exhaust gas scrubbed and a waste solution from a scrubber, by introduction of exhaust gas from the above sulfurization reactor (A), sulfurization reactor (B) or evaporation apparatus into the scrubber, and subjecting it to contact with an alkaline aqueous solution for absorption of hydrogen sulfide gas.

(a) to adjust a total volume ($m^3$) of the sulfurization reactor (B) to be used, so that a ratio of 0.2 to 0.9 ($m^3$/kg/h) is attained relative to input mass per unit hour (kg/h) of nickel contained in the zinc free final solution to be introduced, in the above step (3);

(b) to evaporate under negative pressure, in evaporation of hydrogen sulfide gas dissolved in a solution from slurry generating in the above step (3), and to add the recovered hydrogen sulfide gas into the inside of the sulfurization reactor (B) of the above step (3);

(c) to reuse the hydrogen sulfide gas containing inert components from the sulfurization reactor (B), which gas is accumulated in the gas phase part thereof, by pressure control inside the sulfurization reactor (B), in the above step (3), and add it into the inside of the sulfurization reactor (A) of the above step (2), and (d) to subject the waste solution in the above step (3) and exhaust gas scrubbed in the above step (4) to countercurrent contact, and to introduce the resulting exhaust gas to the scrubber again, and to subject it to contact with the alkaline aqueous solution for absorption of hydrogen sulfide gas, and to charge the resulting waste solution from the scrubber into the sulfurization reactor (B) in the above step (3).

The hydrometallurgical process for a nickel oxide ore, which is a base in the method of the present invention, includes the following steps (1) to (4).

a step (1): to obtain an aqueous solution of crude nickel sulfate containing a zinc as an impurity element, in addition to nickel and cobalt, by High Pressure Acid Leach of a nickel oxide ore;

a step (2): to obtain a zinc sulfide and a zinc free final solution formed, by introduction of the above aqueous solution of crude nickel sulfate into the inside of a sulfurization reactor (A), then the addition of hydrogen sulfide gas, sulfurization of zinc contained in the aqueous solution of crude nickel sulfate, and then solid-liquid separation;

a step (3): to obtain a mixed sulfide of nickel/cobalt and a waste solution, by introduction of the above zinc free final solution into the inside of a sulfurization reactor (B), then the addition of hydrogen sulfide gas, sulfurization of nickel and cobalt contained in the zinc free final solution, and subsequently introduction of slurry formed into an evaporation apparatus for evaporation of hydrogen sulfide gas, and then solid-liquid separation; and a step (4): to obtain an exhaust gas scrubbed and a waste solution from a scrubber, by introduction of exhaust gas from the above sulfurization reactor (A), sulfurization reactor (B) or evaporation apparatus into the scrubber, and subjecting it to contact with an alkaline aqueous solution for absorption of hydrogen sulfide gas.

The above step (1) is a step for obtaining an aqueous solution of crude nickel sulfate containing zinc as an impurity element, in addition to nickel and cobalt, by High Pressure Acid Leach of a nickel oxide ore.

The above step (1), in detail, is composed of a leaching step for obtaining leached slurry, by the addition of sulfuric acid into slurry of a nickel oxide ore and leaching at a high temperature of equal to or high than 200° C. under high pressure using an autoclave, a solid-liquid separation step for separation to the leaching residue in leached slurry and a leachate containing nickel and cobalt, and a neutralization step for forming the neutralized precipitate slurry containing impurity elements such as iron, and a starting solution for a sulfurization reaction scrubbed most parts of the impurity elements, by adjustment of pH of the leachate containing impurity elements, in addition to nickel and cobalt. Here, the High Pressure Acid Leach is not especially limited, and is one, for example, composed of operation to prepare the ore slurry by making the slurry of a nickel oxide ore; and leaching operation to obtain a leachate containing nickel and cobalt, by adding the sulfuric acid to the ore slurry transferred, still more blowing high pressure air as an oxidizing agent and high pressure steam as a heating source, stirring under control at predetermined temperature and pressure, and forming leached slurry composed of a leaching residue and a leachate. Here leaching is carried out under pressure formed by predetermined temperature, for example, 3 to 6 MPaG, therefore, a reactor for high-temperature and high-pressure (autoclave) is used, which is capable of enduring these conditions. In this way, a leaching rate of each of nickel and cobalt of equal to or higher than 90%, and preferably equal to or higher than 95% is obtained.

The above nickel oxide ore is so-called a lateritic ore such as limonite and saprolite. Nickel content in the above lateritic ore is usually 0.5 to 3.0% by mass, and is contained as a hydroxide or a silicic bittern (magnesium silicate) mineral. In addition, iron content is 10 to 50% by mass, and iron is contained mainly as a trivalent hydroxide (goethite, FeOOH), however, divalent iron is partially contained in the silicic bittern mineral.

The above slurry concentration is not especially limited, because it depends largely on properties of a nickel oxide ore to be treated, however, the leached slurry of higher concentration is preferable, and usually adjusted at about 25 to 45% by mass. That is, the leached slurry with a concentration lower than 25% by mass requires a large apparatus to obtain the same residence time in leaching, and also the addition amount of an acid increases for adjustment of the residual acid concentration. In addition, the resulting leachate has lower nickel concentration. In contrast, the leached slurry with a concentration over 45% by mass increases viscosity (yield stress) of slurry itself, and causes a problem of difficult transfer (frequent pipe clogging, high energy requirement etc.), although it requires smaller facility scale.

In the above leaching operation, nickel and cobalt and the like are leached as a sulfate and leached iron sulfate is fixed as hematite, by the leach reaction and the high-temperature hydrolysis represented by the following formulae (1) to (5). However, because fixation of iron ions does not entirely proceed, the divalent and trivalent iron ions are usually contained, besides nickel and cobalt and the like, in a liquid part of the resulting leached slurry.

[Leaching Reaction]

$$MO+H_2SO_4 \rightarrow MSO_4+H_2O \quad (1)$$

(wherein M represents Ni, Co, Fe, Zn, Cu, Mg, Cr, Mn or the like)

$$2FeOOH+3H_2SO_4 \rightarrow Fe_2(SO_4)_3+4H_2O \quad (2)$$

$$FeO+H_2SO_4 \rightarrow FeSO_4+H_2O \quad (3)$$

[High-Temperature Hydrolysis]

$$2FeSO_4+H_2SO_4+\tfrac{1}{2}O_2 \rightarrow Fe_2(SO_4)_3+H_2O \quad (4)$$

$$Fe_2(SO_4)_3+3H_2O \rightarrow Fe_2O_3+3H_2SO_4 \quad (5)$$

Temperature to be used in the above leaching operation is not especially limited, however, it is preferably 220 to 280° C., and more preferably 240 to 270° C. That is, iron is fixed as hematite mostly by carrying out the reaction in this temperature range. In the temperature below 220° C., iron dissolves and remains in the reaction solution, due to low rate of the high-temperature thermal hydrolysis, resulting in increase in load in the subsequent neutralization step for removing the iron, which makes it very difficult to separate the iron from nickel. In contrast, the temperature over 280° C. is not suitable, because not only selection of a material of a reactor to be used for High Pressure Acid Leach is difficult but also cost of steam for raising temperature increases, although the high-temperature thermal hydrolysis itself is promoted.

Amount of sulfuric acid to be used in the above leaching operation is not especially limited, and an excess amount is used so as to leach iron in an ore, for example, the amount of 200 to 500 kg per ton of the ore is used, the addition amount of sulfuric acid over 500 kg per one ton of the ore, is not preferable, due to increased cost of the sulfuric acid. It should be noted that pH of the resulting leachate is preferably adjusted at 0.1 to 1.0, considering filterability of the leaching residue containing hematite generated in the solid-liquid separation step.

The above step (2) is a step for obtaining zinc sulfide and the zinc free final solution formed, by introduction of the aqueous solution of crude nickel sulfate containing zinc as an impurity element in addition to nickel and cobalt into the inside of the sulfurization reactor (A), then the addition of hydrogen sulfide gas, sulfurization of zinc contained in the relevant aqueous solution of crude nickel sulfate, and then solid-liquid separation.

It should be noted that this step is one to prevent the commingling of zinc into the mixed sulfide of nickel/cobalt recovered in the subsequent step (3). Here conditions of the sulfurization reaction are not especially limited, and such conditions are used that zinc is sulfurized preferentially against nickel and cobalt, by the sulfurization reaction.

It should be noted that, in the case where zinc amount contained in the above aqueous solution of crude nickel sulfate is low in a degree not to raise a problem of quality thereof, when zinc is commingled to the mixed sulfide of nickel/cobalt to be formed in the later step, the step (2) may be omitted.

The above step (3) is one for obtaining the mixed sulfide of nickel/cobalt and the waste solution, by introduction of the zinc free final solution obtained in the above step (2) into the inside of the sulfurization reactor (B), then the addition of hydrogen sulfide gas, sulfurization of nickel and cobalt contained in the relevant zinc free final solution, subsequent introduction of slurry formed to the evaporation apparatus for evaporation of hydrogen sulfide gas, and then solid-liquid separation. It should be noted that evaporation of hydrogen sulfide gas from the slurry is carried out for scrubbing treatment of the waste solution.

In the above steps (2) and (3), the method for the addition of hydrogen sulfide gas into the inside of the sulfurization reactors (A) and (B), is not especially limited, however, the addition is carried out by blowing the solution introduced into the sulfurization reactors, into the upper space part (vapor part) or the solution of the sulfurization reactors, under stirring mechanically. It should be noted that as the sulfurization reactors to be used, a closed-type reactor is preferable, which is equipped with a supply port of a reaction starting solution, a outlet of slurry after the reaction, a charge hole of hydrogen sulfide gas and an exhaust gas hole.

The sulfurization reaction to be used in the above steps (2) and (3), is represented by the following formulae (6) to (8):

[Sulfurization Reaction]

$$H_2S(g)+H_2O \rightarrow H_2S \text{ in aq.} \quad (6)$$

$$H_2S \rightarrow H^+ + HS^- \rightarrow 2H^+ + S^{2-} \quad (7)$$

$$M^{2+} + 2H^+ + S^{2-} \rightarrow 2H^+ + MS\downarrow \quad (8)$$

(wherein M represents Ni, Co, Zn or the like.)

Here, firstly, hydrogen sulfide gas added into the inside of the sulfurization reactor requires a dissolving reaction of the hydrogen sulfide gas into water in the above formula (6), and dissolution of the hydrogen sulfide into water in the above formula (7). Here, concentration of dissolved hydrogen sulfide is generally proportional to pressure of hydrogen sulfide in the vapor phase part, according to Henry's law. Therefore, in order to increase a vapor-liquid reaction rate, it is important to increase partial pressure of hydrogen sulfide in the vapor phase part. However, as described above, because the inert component is contained in hydrogen sulfide gas to be added, accumulation of the inert component inside the sulfurization reactor decreases the reaction rate. Therefore, gas of the inert component accumulated was periodically discharged by pressure control inside the sulfurization reactor. That is, supply of hydrogen sulfide gas into the inside of the sulfurization reactor took a system for controlling pressure inside the sulfurization reactor at 50 to 70% of supply pressure of hydrogen sulfide, and such a discharge system was taken that in the timing when pressure inside the sulfurization reactor increased to over control pressure by accumulating the inert component, vapor forming the vapor phase of the sulfurization reactor was discharged from a pressure control valve of the sulfurization reactor. Here, the inert component is accumulated in vapor forming the above vapor phase, and by discharging it from the sulfurization reactor, the above accumulation was eliminated, however, hydrogen sulfide was also discharged accompanying therewith.

Next, by the reaction of the above formula (8), the metal ion in the solution forms a sulfide and is precipitated, however, because zinc provides higher reaction rate as compared with nickel or cobalt by setting suitable conditions, separation of zinc is carried out preferentially firstly in the step (2).

In the sulfurization reaction to be used in the above step (3), seed crystal composed of a sulfide containing nickel and cobalt produced, may be charged into the sulfurization reactor (B), if necessary. Here, ratio of the seed crystal is not especially limited, however, it is preferable to be 150 to 200% by mass, relative to amount of nickel and cobalt to be charged into the sulfurization reactor (B). In this way, it is possible to promote the sulfurization reaction at lower temperature, and at the same time to suppress adhesion of a generated sulfide onto the inner surface of the reactor. That is, it is the result of the facts that an easy deposition state is given by generation of nucleus formation of the sulfide at the surface of the seed crystal, and generation of a fine nucleus of the sulfide inside the reactor is suppressed thereby. In addition, by adjustment of particle size of the seed crystal, the resulting particle size can be controlled.

Temperature to be used in the above sulfurization reaction is not especially limited, however, 65 to 90° C. is preferable. That is, generally the higher temperature promotes much more the sulfurization reaction itself, however, the temperature over 90° C. raises many problems such as cost increase for raising the temperature, adhesion of a sulfide onto the reactor, due to high reaction rate.

The above step (4) is a step for obtaining a scrubbed exhaust gas and a waste solution from the scrubber, by introduction of exhaust gas from the sulfurization reactor (A) of the above step (2), the sulfurization reactor (B) of the above step (3), or the evaporation apparatus of the above step (3), and subjecting it to contact with the alkaline aqueous solution for absorption of hydrogen sulfide gas.

The scrubber to be used in the above step (4) is not especially limited, and for example, such a type is used, that carries out effectively contact between the alkaline aqueous solution and exhaust gas, such as a scrubbing tower.

In the smelting method of the present invention, enhancement of utilization efficiency of hydrogen sulfide gas by adoption of at least one kind of operations of the above (a) to (d), has important technological significance, in the hydrometallurgical process for a nickel oxide ore including the above steps (1) to (4). In this way, although use amount of hydrogen sulfide gas was conventionally about 1.3 to 1.4 time hydrogen sulfide amount required theoretically in view of the sulfurization reaction (formulae (6) to (8)), it can be decreased down to below 1.3 time, preferably down to 1.05 to 1.15 time. In addition, in the operations of (a) to (c), amount of the alkali to be used in exhaust gas treatment is also decreased, accompanying with decrease in use amount of hydrogen sulfide gas.

Explanation will be given below on operations thereof, as well as action effect thereof.

(1) Operation of (a)

Operation of the above (a) is one for adjusting the total volume ($m^3$) of the sulfurization reactor (B) to be used in the step (3), in the hydrometallurgical process for a nickel oxide ore including the above steps (1) to (4), so that total volume becomes a ratio of 0.2 to 0.9 ($m^3$/kg/h), preferably 0.6 to 0.9 ($m^3$/kg/h), relative to input mass per unit hour (kg/h) of nickel contained in the zinc free final solution to be introduced. In this way, by sufficient securing of reaction time of the sulfurization reaction, utilization rate of hydrogen sulfide gas is increased, as well as by promotion of sulfurization of nickel and cobalt, recovery rate is enhanced. It should be noted that use amount of hydrogen sulfide gas can be decreased to 1.1 to 1.2 time of hydrogen sulfide amount required theoretically in view of the sulfurization reaction.

That is, because sulfurization reaction rate of nickel and cobalt is lower as compared with zinc, countermeasures by increase in reaction temperature or control pressure is considered in order to enhance recovery rate, however, it is not preferable due to incurring cost increase for temperature increase or deterioration of utilization rate of hydrogen sulfide gas caused by increase in concentration of hydrogen sulfide in exhaust gas. In addition, implementation of a high-pressure reaction requires enhancement of pressure-proof specifications of an apparatus, which causes increase in apparatus cost. Therefore, operational importance of the apparatus of the sulfurization step is to secure sufficient reaction time, for example, by adjusting the total volume ($m^3$) of the sulfurization reactor (B) to be used in the step (3), so that total volume becomes a ratio of 0.2 to 0.9 ($m^3$/kg/h), relative to input mass per unit hour (kg/h) of nickel contained in the zinc free final solution to be introduced, inner pressure of the sulfurization reactor (B) can be controlled at equal to or lower than 300 kPaG. In addition, by adjusting the total volume ($m^3$) of the above sulfurization reactor (B) so that total volume becomes a ratio of 0.6 to 0.9 ($m^3$/kg/h), relative to input mass per unit hour (kg/h) of nickel contained in the zinc free final solution to be introduced, inner pressure of the sulfurization reactor (B) can be controlled at equal to or lower than 200 kPaG, and also a recovery rate of nickel of equal to or higher than 98% can be attained.

Although the operation of the above (a) can be attained, for example, by scale up of the sulfurization reactor (B), extreme scale up of the sulfurization reactor itself raises problems in view of uniform dispersion of hydrogen sulfide gas into a solution, cost of stirring power and capital investment, and thus it is not especially limited, however, it is preferable industrially to use 3 or 4 units of reactors connected in series. It should be noted here that supply of hydrogen sulfide gas into each of the reactors connected in series is preferably carried out separately so that inner pressure of each of the reactors is controlled at predetermined value. In addition, slurry inside each of the reactors connected in series is transferred in continuous flow from the first stage, to which the zinc free final solution is charged, to the last stage, from which slurry after completion of the reaction is extracted.

(2) Operation of (b)

Operation of the above (b) is one for the addition of recovered hydrogen sulfide gas into the inside of the sulfurization reactor (B) of the above step (3), by evaporation under negative pressure, in evaporation of hydrogen sulfide gas dissolved in a solution, from slurry generated in the above step (3), in the hydrometallurgical process for a nickel oxide ore including the above steps (1) to (4). That is, it is one for recovering the dissolved hydrogen sulfide gas from slurry after completion of the sulfurization reaction by evaporation, to repeatedly re-utilize it in the sulfurization reactor (B). In this way, effective utilization is possible to maintain concentration of hydrogen sulfide dissolved in a solution, which is required to progress the sulfurization reaction. Therefore, it becomes possible not only to decrease charge amount of new hydrogen sulfide gas but also to extremely decrease load of the scrubbing apparatus for scrubbing hydrogen sulfide gas from the above waste solution. In this way, it is possible to decrease use amount of hydrogen sulfide gas down to about 1.1 to 1.2 time of hydrogen sulfide amount required theoretically in view of the sulfurization reaction.

The operation of the above (b) is attained, for example, by introducing slurry after completion of the sulfurization reaction, from the sulfurization reactor to a reactor which is maintained at a lower pressure state than that of the sulfurization reactor, preferably at a negative pressure state, by a pressure decreasing fan or the like, and evaporating the dissolved hydrogen sulfide gas, and then transferring it to the sulfurization reactor by a gas compression apparatus or the like, after removing steam from the evaporated gas by a cooling apparatus or the like.

In the operation of the above (b), the above pressure is not especially limited, as long as it is a negative pressure of equal to or lower than 0 kPaG, however, the negative pressure is preferably equal to or higher than −70 kPaG. That is, the negative pressure lower than −70 kPaG causes a problem of pressure resistance of a reactor to be used in the sulfurization reactor.

(3) Operation of (c)

Operation of the above (c) is one for reusing, from the relevant sulfurization reactor (B), hydrogen sulfide gas containing inert components such as hydrogen, nitrogen or the like accumulated in the gas phase part thereof, by pressure control inside the sulfurization reactor (B) to be used in the above step (3), and adding them into the sulfurization reactor (A) of the above step (2), in the hydrometallurgical process for a nickel oxide ore including the above steps (1) to (4). In this way, it becomes possible to effectively utilize hydrogen sulfide gas containing the inert components, which was conventionally discharged periodically outside the system, as low concentration hydrogen sulfide gas, for the sulfurization reaction of zinc in the sulfurization reactor (A), and thus utilization rate of hydrogen sulfide gas is enhanced, as well as use amount of the alkali in the scrubbing treatment can be saved and decreased. In this way, it becomes possible to decrease use amount of hydrogen sulfide gas down to about 1.1 to 1.2 time of hydrogen sulfide amount required theoretically in view of the sulfurization reaction.

In the operation of the above (c), reuse of hydrogen sulfide gas containing the inert components accumulated in the vapor phase part inside the sulfurization reactor (B), is not especially limited, however, it is carried out so that concentration of hydrogen or nitrogen in the vapor phase part is over predetermined value, as a guideline.

(4) Operation of (d)

Operation of the above (d) is one for subjecting the waste solution in the above step (3) and exhaust gas scrubbed in the above step (4), to countercurrent contact, then introducing the resulting exhaust gas to the scrubber again to subject it to contact with the alkaline aqueous solution for absorption of hydrogen sulfide gas, and charging the resulting waste solution from the scrubber into the sulfurization reactor (B) in the above step (3). In this way, hydrogen sulfide contained in trace amount in the waste solution after evaporation treatment, is transferred into exhaust gas, and can be recovered in the waste solution from the scrubber, and thus can be utilized effectively as a sulfurizing agent. Here, it becomes possible to decrease use amount of hydrogen sulfide gas down to about 1.1 to 1.2 time of hydrogen sulfide amount required theoretically in view of the sulfurization reaction.

The alkaline aqueous solution to be used in the operation of the above (d) is not especially limited, and an aqueous solution of sodium hydroxide is used preferably. Explanation will be given below on use amount of sodium hydroxide in the scrubber here and nickel recovery rate in the step (3).

Figure 2:
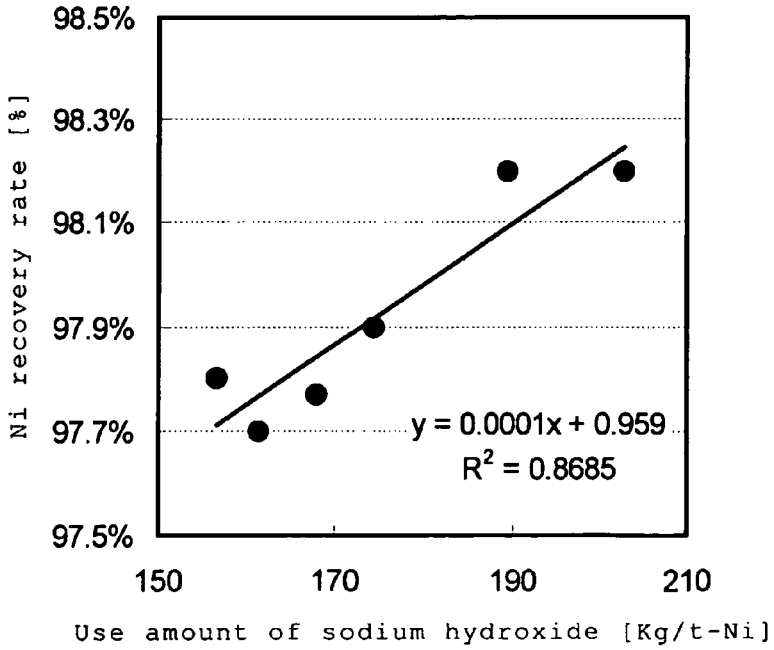
FIG. 2 is a drawing showing relation between ratio of use amount of sodium hydroxide in a scrubber relative to input mass (t) of nickel contained in a zinc free final solution to be introduced to the step (3), and nickel recovery rate.

FIG. 2 shows relation between ratio of use amount (kg) of sodium hydroxide in a scrubber, relative to input mass (t) of nickel contained in a zinc free final solution to be introduced to the step (3), and nickel recovery rate.

It is found from FIG. 2 that use amount of sodium hydroxide in the operation of (d) is not especially limited, however, it is preferable to be adjusted at 180 to 200 kg per 1 ton of input mass of nickel contained in the zinc free final solution to be introduced to the step (3). In this way, a nickel recovery rate of equal to or higher than 98% is attained.

EXAMPLES

Explanation will be given below in further detail on the present invention with reference to Examples of the present invention, however, the present invention should not be limited to these Examples. It should be noted that analysis of metals used in Examples was carried out with an ICP emission spectrometry.

Example 1

Explanation will be given on the case of using the operation of (a) of the hydrometallurgical process for of the present invention. Firstly, according to the process chart shown in FIG. 1, a zinc sulfide and a zinc free final solution were obtained in the step (2), from an aqueous solution of crude nickel sulfate produced from the step (1) of the High Pressure Acid Leach for a nickel oxide ore. It should be noted that the following explanation will relate to volume of a closed-type sulfurization reactor in obtaining a mixed sulfide of nickel/cobalt and a waste solution, by using the above zinc free final solution in the step (3).

As the aqueous solution of crude nickel sulfate, nickel, cobalt, iron and zinc were contained in concentrations of 3 to 4 g/L, 0.2 to 0.4 g/L, 1 to 2 g/L and 0.05 to 0.2 g/L, respectively, and pH was 3.5. In addition, as a closed-type sulfurization reactor of the step (3), three units of the closed-type sulfurization reactors, with a volume of 0.15 $m^3$ per one unit, connected in series, were used.

By continuous introduction of hydrogen sulfide gas with 98% by volume produced in the hydrogen sulfide gas production facility into the inside of the above closed-type sulfurization reactor, operation of the sulfurization reaction was carried out to determine relation between ratio of total volume ($m^3$) of the sulfurization reactor (B) relative to input mass per unit hour (kg/h) of nickel contained in the zinc free final solution to be introduced here, and reaction pressure of the sulfurization reactor, or nickel recovery rate. Results are shown each in FIG. 3 and FIG. 4. It should be noted that the nickel recovery rate was determined from ratio of nickel weight recovered as a sulfide, relative to nickel weight in the aqueous solution of crude nickel sulfate introduced into the sulfurization reactor, by operation of the sulfurization reaction.

Figure 3:
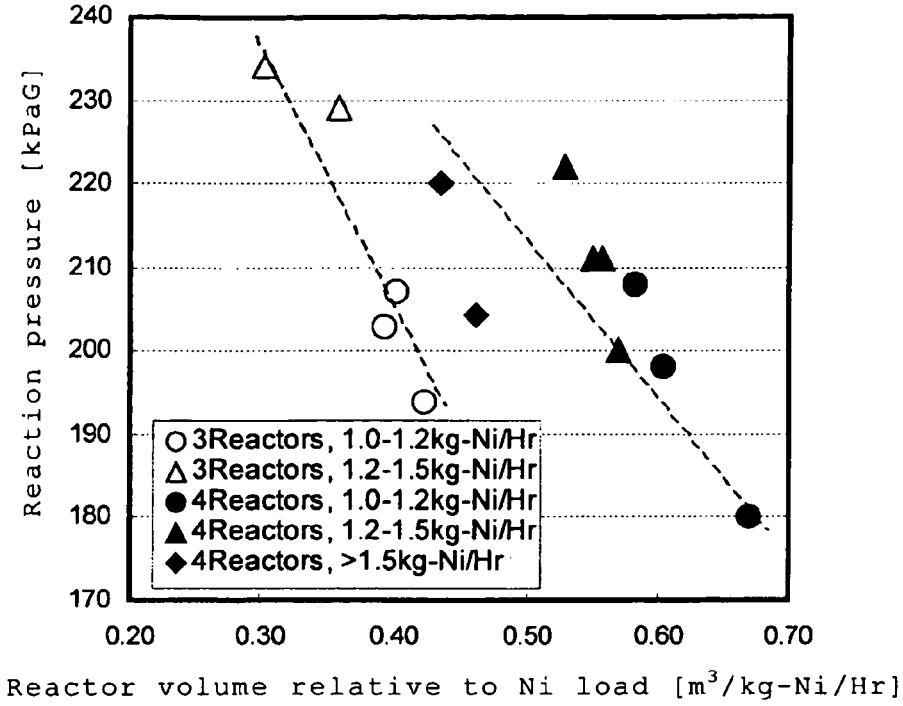
FIG. 3 is a drawing showing relation between reactor volume relative to Ni load ($m^3$/kg/h), and reaction pressure of a sulfurization reactor.

FIG. 3 shows relation between ratio of total volume ($m^3$) of the sulfurization reactor (B) relative to input mass per unit hour (kg/h) of nickel contained in the zinc free final solution to be introduced ("reactor volume relative to Ni load ($m^3$/kg/h)" in this drawing), and reaction pressure of the sulfurization reactor, when the nickel recovery rate of 95 to 99% was obtained. It should be noted here that result is also shown at the same time in the case where a reactor with 0.25 $m^3$ was connected in front of the first unit of the above three units of the connected reactors, to form four units in total connected in series.

It is found from FIG. 3 that by adjusting the reactor volume relative to Ni load ($m^3$/kg/h), so that volume becomes a ratio of 0.2 to 0.9, inner pressure of the sulfurization reactor (B) can be controlled at equal to or lower than 300 kPaG, and by adjusting the reactor volume relative to Ni load ($m^3$/kg/h), so that volume becomes a ratio of 0.6 to 0.9 ($m^3$/kg/h), inner pressure of the sulfurization reactor (B) can be controlled at equal to or lower than 200 kPaG.

Figure 4:
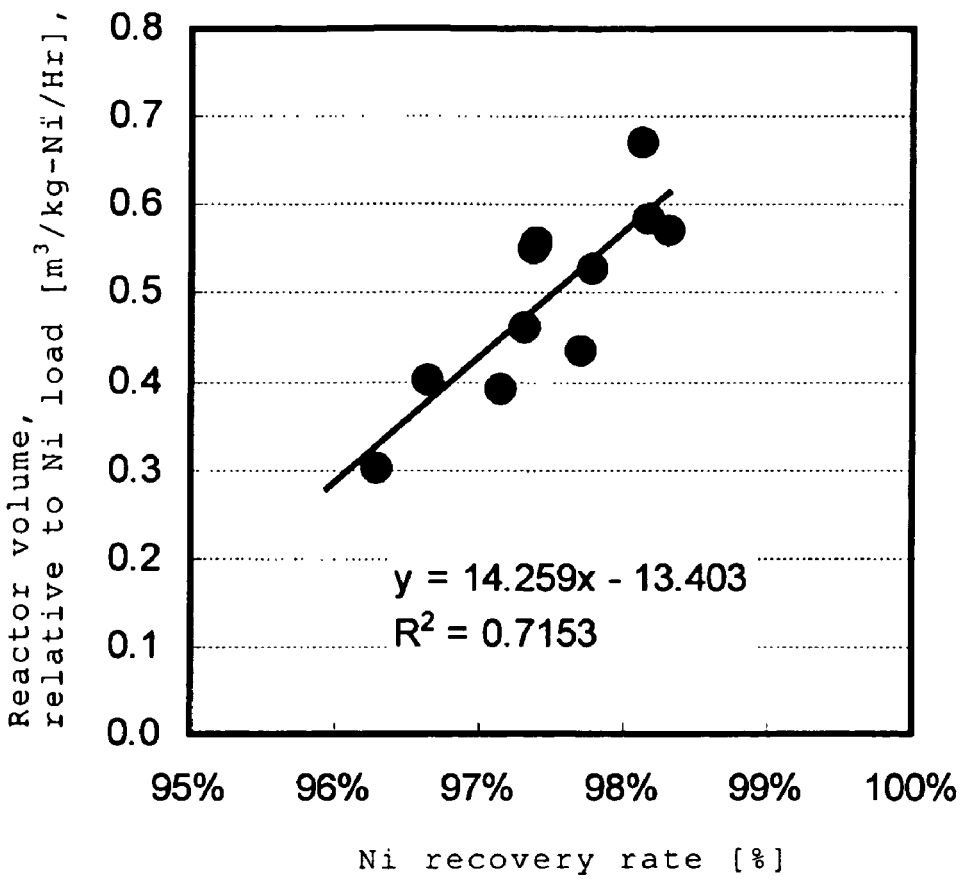
FIG. 4 is a drawing showing relation between nickel recovery rate and reactor volume relative to Ni load ($m^3$/kg/h)

FIG. 4 shows relation between nickel recovery rate in the case where solution flow amount was changed variously under condition of the inner pressure of the sulfurization reactor fixed at constant value, and ratio of total volume ($m^3$) of the sulfurization reactor (B) relative to input mass per unit hour (kg/h) of nickel contained in the zinc free final solution to be introduced ("reactor volume, relative to Ni load ($m^3$/kg/h)" in this drawing).

It is understood from FIG. 4 that by setting the reactor volume relative to Ni load ($m^3$/kg/h), to be equal to or higher than 0.6, a nickel recovery rate of equal to or higher than 98% can be obtained.

As described above, because sufficient nickel recovery rate can be obtained under condition of decreased inner pressure of the sulfurization reactor (B) to 300 kPaG, preferably equal to or lower than 200 kPaG, utilization rate of hydrogen sulfide gas increases. In this case, use amount of hydrogen sulfide gas was able to decrease down to 1.2 time of hydrogen sulfide amount required theoretically in view of the sulfurization reaction.

Example 2

Explanation will be given on the case using the operations of (a) and (d) of the hydrometallurgical process for of the present invention. Firstly, according to the process chart shown in FIG. 1, a mixed sulfide of nickel/cobalt and a waste solution were obtained in the step (3), using the zinc free final solution after separation of zinc as a sulfide in the step (2) from the aqueous solution of crude nickel sulfate produced from the step (1) of the High Pressure Acid Leach for a nickel oxide ore. It should be noted that the following explanation will relate to the waste solution obtained in the step (3) and the waste solution from the scrubber obtained in the step (4).

The aqueous solution of crude nickel sulfate and the closed-type sulfurization reactor of the step (3) were similar as in Example 1. In addition, the reactor volume relative to Ni load ($m^3$/kg/h) was adjusted at 0.6.

Here, the waste solution in the above step (3) and exhaust gas scrubbed in the above step (4) were subjected to contacting, in counter-flow, by using a scrubbing tower, and then the resulting exhaust gas was introduced again into the scrubber for absorption of hydrogen sulfide gas, by being subjected to contact with the aqueous solution of sodium hydroxide, and the resulting waste solution from the scrubber was charged into the sulfurization reactor (B) of the above step (3). It should be noted here that in the scrubber, the aqueous solution of sodium hydroxide, with a concentration of 25% by mass, was used, and use amount of sodium hydroxide was adjusted at 190 kg per 1 ton of input mass of nickel contained in the zinc free final solution to be introduced to the step (3).

In this case, use amount of hydrogen sulfide gas was able to decrease down to 1.06 time of hydrogen sulfide amount required theoretically in view of the sulfurization reaction. In addition, nickel recovery rate was 98%.

Example 3

Explanation will be given on the case of using the operations of (a) and (b) of the hydrometallurgical process for of the present invention. Firstly, according to the process chart shown in FIG. 1, a mixed sulfide of nickel/cobalt and a waste solution were obtained in the step (3), using the zinc free final solution after separation of zinc as a sulfide in the step (2) from the aqueous solution of crude nickel sulfate produced from the step (1) of the High Pressure Acid Leach for a nickel oxide ore. It should be noted that the following explanation will relate to the waste solution obtained in the step (3).

The aqueous solution of crude nickel sulfate and the closed-type sulfurization reactor of the step (3) were similar as in Example 1. In addition, the reactor volume relative to Ni load ($m^3$/kg/h) was adjusted at 0.6.

Here, slurry discharged from the sulfurization reactor at the final stage was introduced into a reactor maintained at a negative pressure state of −68 kPaG by a pressure decreasing fan, and hydrogen sulfide gas dissolved in the solution was evaporated, and then charged to the sulfurization reactor (B) by a compressor, after removing steam from the evaporated gas by cooling.

In this case, use amount of hydrogen sulfide gas was able to decrease down to 1.08 time of hydrogen sulfide amount required theoretically in view of the sulfurization reaction. In addition, nickel recovery rate was 98%.

Example 4

Explanation will be given on the case using the operations of (a) and (c) of the hydrometallurgical process for of the present invention. Firstly, according to the process chart shown in FIG. 1, a mixed sulfide of nickel/cobalt and a waste solution were obtained in the step (3), using the zinc free final solution after separation of zinc as a sulfide in the step (2) from the aqueous solution of crude nickel sulfate produced from the step (1) of the High Pressure Acid Leach for a nickel oxide ore. It should be noted that the following explanation will relate to the exhaust gas obtained in the step (3).

The aqueous solution of crude nickel sulfate and the closed-type sulfurization reactor of the step (3) were similar as in Example 1. In addition, the reactor volume relative to Ni load ($m^3$/kg/h), was adjusted at 0.6

Here, exhaust gas extracted from the sulfurization reactor was charged inside the sulfurization reactor of the step (2). In this case, use amount of hydrogen sulfide gas was able to decrease down to 1.07 time of hydrogen sulfide amount required theoretically in view of the sulfurization reaction. In addition, nickel recovery rate was 98%.

From the above, it is understood that, in Examples 1 to 4, by adoption of at least one kind of the above (a) to (d), in the hydrometallurgical process for a nickel oxide ore including the above steps (1) to (4), use amount of hydrogen sulfide gas can decrease down to 1.05 to 1.2 time of hydrogen sulfide amount required theoretically in view of the sulfurization reaction, which was conventionally 1.3 to 1.4 time.

As is clear from the above, the hydrometallurgical process for a nickel oxide ore of the present invention, is suitable as the hydrometallurgical process for a nickel oxide ore, which is capable of enhancing utilization efficiency of hydrogen sulfide gas, while maintaining nickel recovery rate to a high yield in the mixed sulfide of nickel/cobalt, in the hydrometallurgical process for a nickel oxide ore using the above High Pressure Acid Leach.

What is claimed is:

1. A hydrometallurgical process for a nickel oxide ore comprising:

step (1): obtaining an aqueous solution of crude nickel sulfate containing zinc as an impurity element, in addition to nickel and cobalt, by high pressure acid leach of a nickel oxide ore;

step (2): obtaining zinc sulfide and a zinc free final solution, by introducing the aqueous solution of crude nickel sulfate into a sulfurization reactor (A), adding hydrogen sulfide gas, sulfurization of zinc contained in said aqueous solution of crude nickel sulfate, and then performing solid-liquid separation;

step (3): obtaining a mixed sulfide of nickel/cobalt and a waste solution, by introducing the zinc free final solution into a sulfurization reactor (B), adding hydrogen sulfide gas, sulfurization of nickel and cobalt contained in said zinc free final solution, subsequently introducing a formed slurry into an evaporation apparatus for evaporation of hydrogen sulfide gas, and then performing solid-liquid separation; and step (4): obtaining an exhaust gas scrubbed and a waste solution from a scrubber, by introducing exhaust gas from the sulfurization reactor (A), the sulfurization reactor (B) or the evaporation apparatus into the scrubber, and contacting the exhaust gas with an alkaline aqueous solution for absorption of hydrogen sulfide gas;

wherein said process further comprises operation (a):

(a) adjust total volume ($m^3$) of the sulfurization reactor (B) so that a ratio of 0.2 to 0.9 ($m^3$/kg/h) is attained relative to input mass per unit hour (kg/h) of nickel contained in the introduced zinc free final solution in step (3);

and said process optionally comprises one or more operations selected from operations (b), (c) and (d):

(b) evaporate under negative pressure hydrogen sulfide gas dissolved in a solution of said slurry in step (3) to recover hydrogen sulfide gas, and add the recovered hydrogen sulfide gas into the sulfurization reactor (B) of (3);

(c) reuse the hydrogen sulfide gas containing inert components from said sulfurization reactor (B), wherein the gas is accumulated in the gas phase part thereof, by controlling pressure inside the sulfurization reactor (B) in step (3); and add the gas into the sulfurization reactor (A) of step (2); and (d) subject the waste solution in step (3) and exhaust gas scrubbed in step (4) to countercurrent contact, introduce the resulting exhaust gas to the scrubber again, contact the resulting exhaust gas with the alkaline aqueous solution for absorption of hydrogen sulfide gas, and charge the resulting waste solution from the scrubber into the sulfurization reactor (B) in step (3).

2. The hydrometallurgical process for a nickel oxide ore according to claim 1, wherein in the operation (a), the ratio is 0.6 to 0.9 ($m^3$/kg/h).

3. The hydrometallurgical process for a nickel oxide ore according to claim 1, wherein in the operation (a), the sulfurization reactor (B) comprises three or four units of reactors connected in series.

4. The hydrometallurgical process for a nickel oxide ore according to claim 1, wherein, in the operation (b), the negative pressure is equal to or higher than −70 kPaG.

5. The hydrometallurgical process for a nickel oxide ore according to claim 1, wherein, in the operation (d), the alkaline aqueous solution is an aqueous solution of sodium hydroxide, wherein the amount of sodium hydroxide used is adjusted to 180 to 200 kg per 1 ton of input mass of nickel contained in the zinc free final solution to be introduced into the step (3).

6. A hydrometallurgical process for a nickel oxide ore comprising:

step (1): obtaining an aqueous solution of crude nickel sulfate containing zinc as an impurity element, in addition to nickel and cobalt, by high pressure acid leach of a nickel oxide ore;

step (2): obtaining zinc sulfide and a zinc free final solution by introducing the aqueous solution of crude nickel sulfate into a sulfurization reactor (A), adding hydrogen sulfide gas, sulfurization of zinc contained in the aqueous solution of crude nickel sulfate, and then performing solid-liquid separation;

step (3): obtaining a mixed sulfide of nickel/cobalt and a waste solution, by introducing the zinc free final solution into a sulfurization reactor (B), adding hydrogen sulfide gas, sulfurization of nickel and cobalt contained in the zinc free final solution, subsequently introducing a formed slurry into an evaporation apparatus for evaporation of hydrogen sulfide gas, and then performing solid-liquid separation; and step (4): obtaining a scrubbed exhaust gas and a waste solution from a scrubber, by introducing an exhaust gas from the sulfurization reactor (A), the sulfurization reactor (B) or the evaporation apparatus into the scrubber, and contacting the exhaust gas with an alkaline aqueous solution for absorption of hydrogen sulfide gas;

wherein said hydrometallurgical process comprises at least one of operation (a) and operation (d):

(a) adjust a total volume ($m^3$) of the sulfurization reactor (B) to obtain a ratio of 0.2 to 0.9 ($m^3$/kg/h) of the total volume relative to input mass per unit hour (kg/h) of nickel contained in the zinc free final solution introduced in step (3); and (d) subject the waste solution in step (3) and exhaust gas scrubbed in step (4) to countercurrent contact, introduce the resulting exhaust gas to the scrubber again, contact the resulting exhaust gas with the alkaline aqueous solution for absorption of hydrogen sulfide gas, and charge the resulting waste solution from the scrubber into the sulfurization reactor (B) in step (3).

7. The hydrometallurgical process of claim 6, wherein said process further comprises operation (b):

(b) evaporate, under negative pressure, hydrogen sulfide gas dissolved in a solution of said slurry in step (3) to recover hydrogen sulfide gas, and add the recovered hydrogen sulfide gas into the sulfurization reactor (B) of step (3).

8. The hydrometallurgical process of claim 6, wherein said process further comprises operation (c):

(c) reuse hydrogen sulfide gas containing inert components from said sulfurization reactor (B), wherein the gas is accumulated in a gas phase part thereof, by controlling pressure inside the sulfurization reactor (B) in step (3); and add the hydrogen sulfide gas into the sulfurization reactor (A) of step (2).

* * * * *